US009428855B2

(12) United States Patent
Park

(10) Patent No.: US 9,428,855 B2
(45) Date of Patent: Aug. 30, 2016

(54) WASHING MACHINE

(71) Applicant: SAMSUNG ELECTRONICS CO., LTD., Suwon-si, Gyeonggi-do (KR)

(72) Inventor: Nae Young Park, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 612 days.

(21) Appl. No.: 13/849,629

(22) Filed: Mar. 25, 2013

(65) Prior Publication Data

US 2013/0255327 A1 Oct. 3, 2013

(30) Foreign Application Priority Data

Mar. 27, 2012 (KR) ..... 10-2012-0031026

(51) Int. Cl.
*D06F 39/00* (2006.01)
*D06F 35/00* (2006.01)
*A47L 15/42* (2006.01)

(52) U.S. Cl.
CPC ..... *D06F 39/005* (2013.01); *D06F 35/00* (2013.01); *A47L 15/4293* (2013.01)

(58) Field of Classification Search
CPC ... D06F 39/005; D06F 35/00; A47L 15/4293
See application file for complete search history.

(56) References Cited

U.S. PATENT DOCUMENTS

2007/0101512 A1* 5/2007 Lee ..... D06F 39/081 8/158
2007/0113594 A1* 5/2007 Ahn ..... D06F 39/005 68/3 R
2009/0235465 A1* 9/2009 Klug ..... D06F 37/42 8/149.3
2009/0282874 A1* 11/2009 Lee ..... D06F 33/00 68/12.12
2010/0066554 A1* 3/2010 Lee ..... D06F 39/00 340/679
2010/0259403 A1 10/2010 Cho et al.
2012/0056827 A1* 3/2012 Kim ..... D06F 39/005 345/173

FOREIGN PATENT DOCUMENTS

| | | |
|---|---|---|
| CN | 101381950 | 3/2009 |
| CN | 101696543 | 4/2010 |
| CN | 102388573 | 3/2012 |
| EP | 2 031 121 | 3/2009 |
| EP | 2 426 244 | 3/2012 |
| KR | 10-2003-0049719 | 6/2003 |

(Continued)

OTHER PUBLICATIONS

European Search Report issued May 21, 2015 in corresponding European Patent Application No. 13161370.5.

(Continued)

*Primary Examiner* — Joseph L Perrin
(74) *Attorney, Agent, or Firm* — Staas & Halsey LLP

(57) ABSTRACT

A washing machine having a structure capable of preventing moisture from being penetrated to the inside the control panel assembly while easily transmitting sound generated from the speaker, the washing machine including a cabinet, a control panel disposed on a front surface of the cabinet, a display unit installed on the control panel such that a front surface of the display unit is exposed to a front of the control panel, a speaker disposed at a rear of the control panel, and a speaker hole provided through the control panel so that sound being generated from the speaker is transmitted to outside the control panel, wherein the speaker hole is disposed to be spaced apart from the speaker.

18 Claims, 9 Drawing Sheets

(56) References Cited

FOREIGN PATENT DOCUMENTS

| | | |
|---|---|---|
| KR | 10-2009-0041003 | 4/2009 |
| KR | 10-2010-0120049 | 11/2010 |
| WO | WO 2013/090334 | 7/2011 |

OTHER PUBLICATIONS

European Decision on Grant issue Feb. 3, 2016 in corresponding European Patent Application No. 13 161 370.5.

Chinese Office Action issued Feb. 3, 2016 in corresponding Chinese Patent Application No. 201310102449.4.

* cited by examiner

WASHING MACHINE

CROSS-REFERENCE TO RELATED APPLICATIONS

This application claims the benefit of Korean Patent Application No. 10-2012-0031026, filed on Mar. 27, 2012 in the Korean Intellectual Property Office, the disclosure of which is incorporated herein by reference.

BACKGROUND

1. Field

Embodiments of the present disclosure relate to a washing machine provided with a control panel assembly on which a speaker and a display unit in a touch screen are provided.

2. Description of the Related Art

A washing machine is a machine to wash clothes by use of electric power. In general, a washing machine includes a tub to accommodate wash water, a drum rotatably installed at an inside the tub, and a motor to drive a rotating operation of the drum.

In a state of having the laundry and the detergent water input in the drum, if the drum is rotated by the motor, the dirt on the laundry is removed by friction among the laundry, the drum and the detergent water.

According to the technology development in recent years, a user is accustomed to operating a machine through a display unit in a touch screen scheme.

In addition, a technology has been developed to represent the operating status of a machine through a human voice or real music as well as through a simple buzzer sound or a simple melody.

Numerous studies have been conducted to apply such a technology to a washing machine for user's convenience.

SUMMARY

Therefore, it is an aspect of the present disclosure to provide a washing machine having a structure capable of easily transmitting sound, which is generated from a speaker, while preventing moisture from being infiltrated to the inside a control panel assembly.

Additional aspects of the disclosure will be set forth in part in the description which follows and, in part, will be apparent from the description, or may be learned by practice of the disclosure.

In accordance with one embodiment of the present disclosure, a washing machine includes a cabinet, a control panel, a display unit, a speaker and a speaker hole. The control panel may be disposed on a front surface of the cabinet. The display unit may be installed on the control panel such that a front surface of the display unit is exposed through a front of the control panel. The speaker may be disposed at a rear of the control panel. The speaker hole may be formed through the control panel so that sound being generated from the speaker is transmitted to outside the control panel. The speaker hole may be disposed to be spaced apart from the speaker.

The washing machine may further include a shielding unit formed at a rear surface of the control panel to cover a rear of the speaker hole.

The shielding unit may include at least one side shielding film protruding from the control panel to the rear of the control panel so as to block moisture from being introduced to the inside the control panel through the speaker hole.

The side shielding film may include a first-side shielding film and a second-side shielding film that are formed at both sides of the speaker hole, respectively.

The at least one of the first-side shielding film and the second-side shielding film may be inclined such that the first-side shielding film and the second-side shielding film are adjacent to each other while coming together from the speaker to the speaker hole.

The side shielding film may be configured to guide the sound, which is generated from the speaker, to the speaker hole.

The shielding unit may further include a rear shielding film provided in parallel to the control panel so as to block the moisture from being introduced to the inside the control panel.

The rear shielding film may be supported by the at least one side shielding film.

The shielding unit may include a drain hole that is formed while being open through a lower end of the shielding unit to discharge moisture that is input through the speaker hole.

The washing machine may further include a speaker housing which is installed at the rear surface of the control panel and on which the speaker is mounted.

The speaker housing may include a guide rib that protrudes toward a front of the speaker housing.

The guide rib may be provided to guide the sound, which is generated from the speaker, toward the speaker hole.

The speaker may be mounted at a rear side of the speaker housing, and the speaker housing may include an opening that is open through a part of the speaker housing.

The guide rib may be provided adjacent to the opening.

The display unit may include a display unit in a touch screen scheme.

The display unit may include a touch sensor.

In accordance with another aspect of the present disclosure, a washing machine includes a cabinet, and a control panel assembly. The control panel assembly may be disposed on a front surface of the cabinet. The control panel assembly may include a control panel, a speaker, a speaker hole and a guide rib. The control panel may form an external appearance of the control panel assembly. The speaker may be disposed at a rear of the control panel. The speaker hole may be formed while being open through a part of the control panel. The guide rib may be configured to guide sound, which is generated from the speaker, toward the speaker hole.

The speaker hole may be located at a position lower than a position of the speaker.

The guide rib may include a first guide rib that protrudes from a rear surface of the control panel.

The control panel assembly may further include a speaker housing allowing the speaker to be mounted on a rear side thereof.

The guide rib may include a second guide rib protruding from a front surface of the speaker housing.

The speaker housing may include at least one fixing clip configured to fix the speaker to a rear surface of the speaker housing.

The speaker may include a fixing protrusion that is configured to be fixed to the fixing clip.

As described above, a washing machine in accordance with the present disclosure can easily transmit the sound, which is transmitted from the speaker, through a speaker hole while preventing moisture from being penetrated to the inside the control panel assembly through the speaker hole.

A user convenience is provided through the display device in a touch screen scheme.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
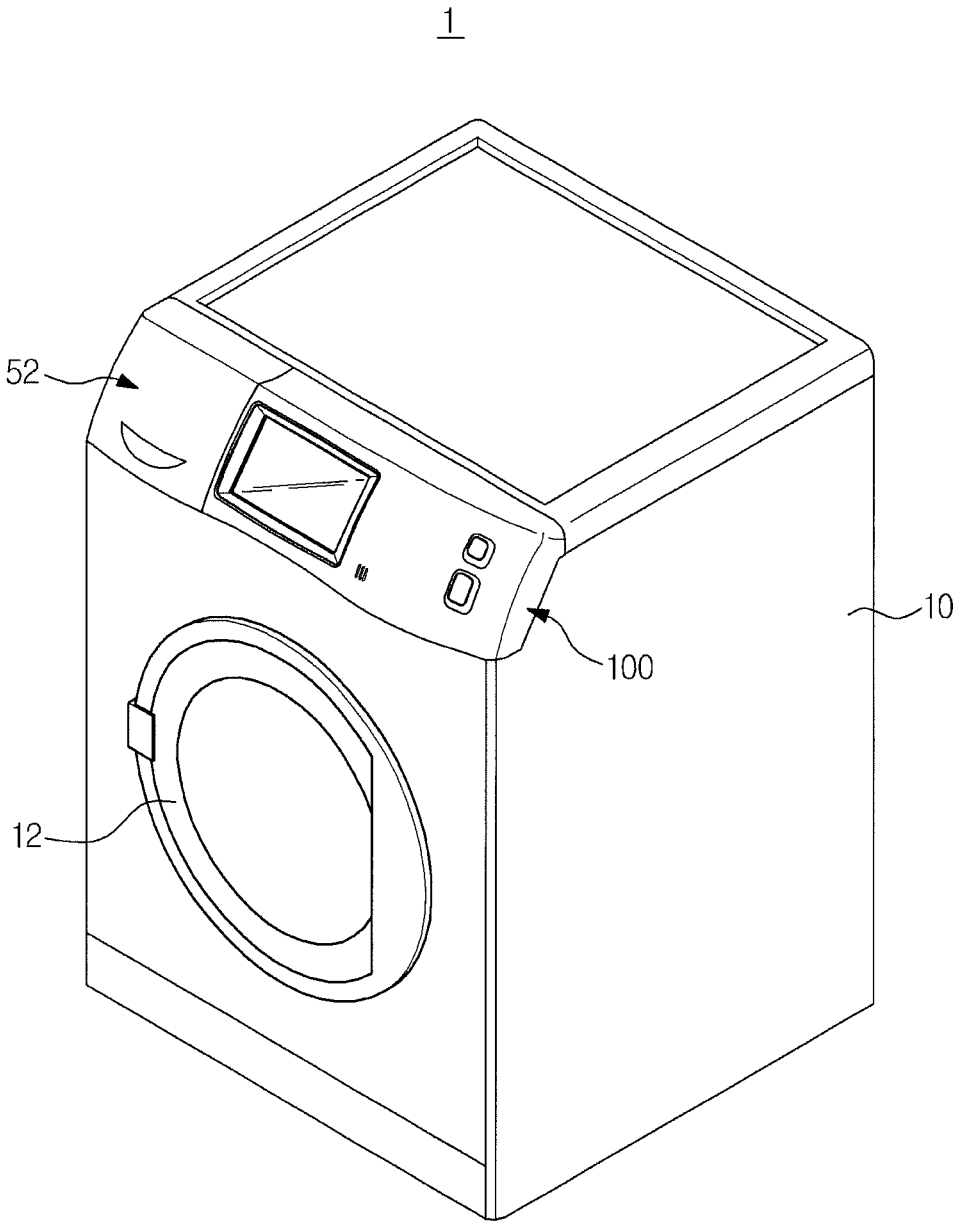
FIG. 1 is a perspective view illustrating the configuration of a washing machine in accordance with an embodiment of the present disclosure.

Reference will now be made in detail to the embodiments of the present disclosure, examples of which are illustrated in the accompanying drawings, wherein like reference numerals refer to like elements throughout.

Figure 2:
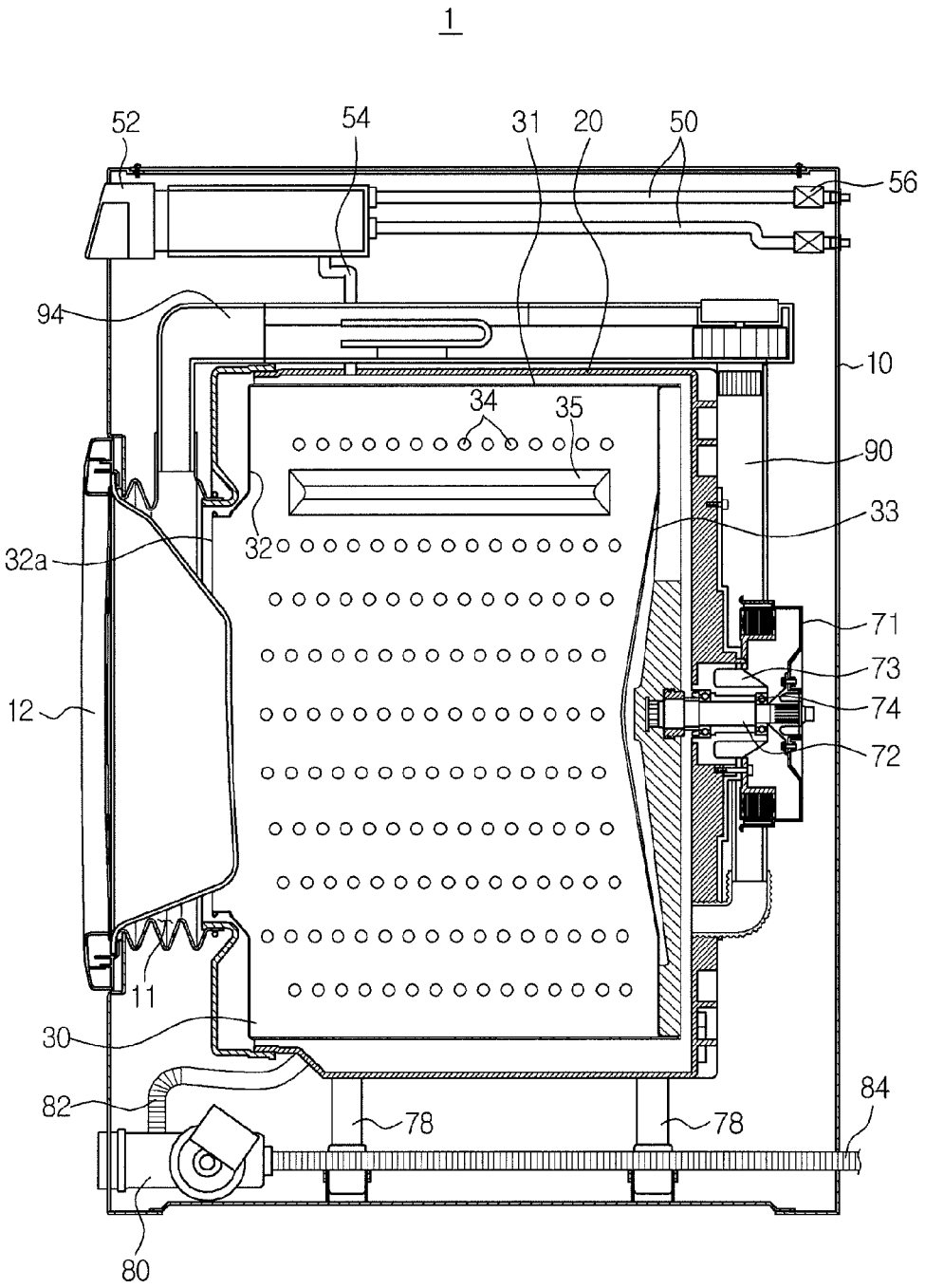
FIG. 2 is a cross sectional view of the washing machine of FIG. 1.

FIG. 1 is a perspective view illustrating the configuration of a washing machine in accordance with an embodiment of the present disclosure. FIG. 2 is a cross sectional view of the washing machine of FIG. 1.

Referring to FIGS. 1 and 2, a washing machine 1 includes a cabinet 10 forming the external appearance of the washing machine, a tub 20 disposed at an inside the cabinet 10, a drum 30 rotatably disposed at an inside the cabinet 10, and a motor 71 to drive the drum 30.

An inlet 11 is formed at a front side of the cabinet 10 such that a laundry is input through the inlet 11 to the inside the drum 30. The inlet 11 is open and closed by a door 12 installed at the front side of the cabinet 10.

The tub 20 is supported by a damper 78. The damper 78 connects a bottom surface of the inner side of the cabinet 10 to an outer surface of the tub 20.

The tub 20 is provided at an upper side thereof with a water supply pipe 50 to supply wash water to the tub 20. One side of the water supply pipe 50 is connected to a water supply valve 56, and the other side of the water supply pipe 50 is connected to a detergent container 52.

The detergent container 52 is connected to the tub 20 through a connection pipe 54. Water being supplied through the water supply pipe 50 is supplied via the detergent container 52 to the inside the tub 20 together with detergent.

The tub 20 is provided at a lower side thereof with a drain pump 80 and a drain pipe that are configured to discharge water at an inside of the tub to the outside.

The drum 30 includes a cylindrical part 31, a front side panel 32 disposed at a front of the cylindrical part 31, and a rear side panel 33 disposed at a rear of the cylinder part 31. The front side panel 32 has an opening 32*a* allowing a laundry to input and withdraw therethrough. A driving shaft 72 configured to transmit power of the motor 71 is connected to the rear side panel 33.

A plurality of through-holes 34 is formed through a circumference of the drum 20 to circulate wash water. The interior space of the drum 30 communicates with the interior space of the tub 20.

A plurality of lifters 35 is installed at an inner circumferential surface of the drum 30 such that the ascending and descending of the laundry is achieved when the drum 30 rotates.

The driving shaft 72 is disposed between the drum 30 and the motor 71. One end of the driving shaft 72 is connected to the rear side panel 33 of the drum 30, and the other end of the driving shaft 72 extends to the outside a rear wall of the tub 20. As the motor 71 drives the driving shaft 72, the drum 30 being connected to the driving shaft 72 rotates on the driving shaft 72.

A bearing housing 73 is installed at the rear wall of the tub 20 so as to rotatably support the driving shaft 72. The bearing housing 73 is formed of an aluminum alloy, and may be inserted into the rear wall of the tub 20 at the time of injection molding of the tub 20. A plurality of bearings 74 are installed between the bearing housing 73 and the driving shaft 72 such that the driving shaft 72 is smoothly rotated.

At a lower side of the tub 20, a drain pump 80 to discharge at the inside the tub 20 to the outside the cabinet 10, a connection hose 82 connecting the tub 20 to the drain pump 80 such that water at an inside the tub 20 is introduced to the drain pump 80, and a drain hose 84 configured to guide the water pumped by the drain pump 80 to the outside the cabinet 10.

A dry apparatus 90 is mounted at the tub 20 such that air at an inside the tub 20 is supplied to the inside the tub 20 again after being dried. The drying apparatus 90 includes a drying duct 94 that is configured to circulate dry air while communicating with the front surface of the tub 10.

During a wash cycle, the motor 71 rotates the drum 30 forward and backward at a low speed, and accordingly, the laundry at an inside the drum 30 repeatedly ascends and descends, thereby removing dirt from the laundry.

During a spin dry cycle, the motor 71 rotates the drum 30 in one direction at a high speed, so that water is separated from the laundry by a centrifugal force acting on the laundry.

When the drum 30 rotates during the spin dry cycle, if the laundry is positioned at a certain position without evenly distributed at an inside the drum 30, an unbalance load occurs in the drum 30, and thus the rotation motion of the drum 30 is unstable and the vibration and noise are generated. Accordingly, the washing machine 1 is provided with a balancer (not shown) to stabilize the rotation of the drum 30. The balancer (not shown) is provided in one pair of balancers, one for each of the front side panel 32 and the rear side panel 33.

Meanwhile, a control panel assembly 110 is provided at an upper portion of the front surface of the cabinet 10 for a user to control the operation of the washing machine 1.

Figure 3:
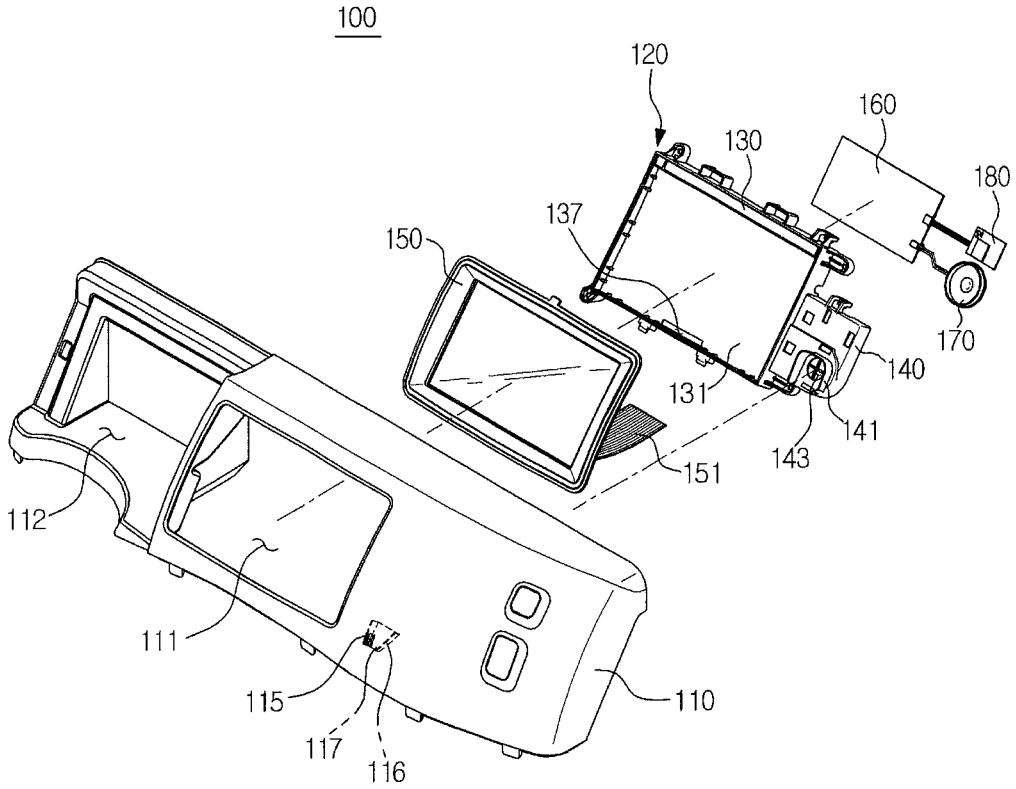
FIG. 3 is a perspective view illustrating the configuration of a control panel assembly of the washing machine of FIG. 1.

FIG. 3 is a perspective view illustrating the configuration of a control panel assembly of the washing machine of FIG. 1.

Referring to FIG. 3, the control panel assembly 100 includes a control panel 110 that forms the external appearance of the control panel assembly 100 and mounted at the upper portion of the front surface of the cabinet (10 in FIG. 1) while being inclined.

A detergent container accommodating port 112 is formed through a part of the control panel 110 such that the detergent container 52 is detachable toward the inside the cabinet.

A display unit mounting port 111 is provided at a center of the control panel 110 while being penetratively formed through a part of the control panel 110 such that the display unit 150 is exposed to the front of the control panel 110.

The display unit 150 outputs washing operation related information, such as operating information of the washing machine, details of a washing operation or the operation status of the wash cycle. According to an embodiment of the present disclosure, the display unit 150 may perform as an input function as well as a display function.

In a case that the display unit 150 is provided in a touch screen scheme, the display unit 150 may perform the input function as well as the display function.

The display unit 150 may include a touch sensor (not shown) to sense a touch by a user. The touch sensor (not shown) may be provided in a layer structure with a display panel (not shown) of the display unit 150.

The touch sensor (not shown) is configured to convert the change in pressure applied to a certain position of the display unit 150 or the change in capacitance being generated in a certain position of the display unit 150 to an electric input signal. The touch sensor (not shown) may be configured to detect a pressure at the time of being touched, as well as the position and area touched.

The display unit 150 is mounted on the housing 120. The housing 120 includes a display housing 130 on which the display unit 150 is mounted, and a speaker housing 140 on which the speaker 170 is mounted.

The display unit 150 is mounted at a front surface 131 of the display housing 130, and a main board 160 is mounted at a rear surface (not shown) of the display housing 130. The display unit 150 is electrically connected to the main board 160 through a cable 151. The cable 151 may extend to the main board 160 by passing over the lower end of the display housing 130. Alternatively, a through-hole 137 is formed through a part of the front surface 131 of the display housing 130, so that the display unit 150 may be connected to the main board 160 through the cable 151 passing through the through-hole 137.

The speaker housing 140 is disposed at a lateral side of the display housing 130 such that the speaker 170 is mounted on the speaker housing 140.

The display housing 130 is integrally formed with the speaker housing 140. According to another embodiment of the present disclosure, the display housing 130 and the speaker housing 140 may be separately formed from each other and assembled to each other.

The speaker 170 is connected to the main board 160.

The speaker 170 is a type of an acoustic sound playback apparatus capable of replaying a melody, for example, a buzzer. Since the speaker 170 implements sound by vibrating a vibration plate or a vibration membrane, a wide range of sound and tone is generated, and thus various types of sound audible to humans are replayed as well as human voices.

Through the speaker 170, at the time of the on/off of the washing machine and the start/stop/end of a wash cycle, or the selecting of the wash course and the selecting of a function of a washing operation, an alarm sound is generated. Such an alarm sound includes a constant melody sound as well as a sound of a constant tone. Further, since the speaker 170 is employed, the alarm sound may be generated using the human voice.

The sound generated by the speaker 170 is not limited thereto, and may include various types of sound. In addition to generating a sound to indicate the function and the operating status of the washing machine 1, a music desired by a user may be replayed or various types of sound being transmitted from a terminal (not shown) may be replayed.

The speaker 170 is mounted at the rear surface of the speaker housing 140. An opening 143 is formed at a portion of the speaker housing 140, on which the speaker 170 is mounted, such that sound being generated from the speaker 170 passes through the opening 143.

A guide rib 141 is formed around the opening 143 while protruding to the front of the speaker housing 140.

A communication module 180 is connected to the main board 160.

The washing machine 1 is connected to an outside Internet through the communication module 180. The outside Internet being connected to the washing machine 1 includes various types of communication links, for example, a ZigBee communication network, a WIFI communication network, a Bluetooth communication network, a mobile communication network, a local-area network (LAN), a wide-area network (WAN), and a point to point telephone line connection.

The communication module 180 is configured to connect the washing machine 1 to the outside Internet, and may include a ZigBee communication module, a WIFI communication module, a Bluetooth communication module, and an AP module.

The terminal (not shown) is an apparatus designed to execute an exclusive Application (hereinafter, referred to as App) for performing a remote control setting of the washing machine while being connected to the communication module 180 mounted on the washing machine 1, and the terminal may include all the devices connectable to the outside Internet. That is, the terminal (not shown) is an apparatus to transmit remote control information from a user such that the washing machine 1 is controlled in a remote method.

The terminal (not shown) includes smart phones, personal digital assistances (PDA), portable multimedia players (PMP), notebooks, and desktop computers, and may be provided with an input apparatus, such as a key, a button, a switch, and a touch pad so as to enable an input of the remote control information through manipulation by a user. In addition, the terminal (not shown) includes a device, for example, a digital camera and a camcorder, equipped with various functions implemented using various application programs.

In addition, an App is installed on the terminal (not shown) to proceed with the remote control setting of the washing machine 1, and the App for the terminal (not shown) may be additionally installed depending on the use.

Figure 4:
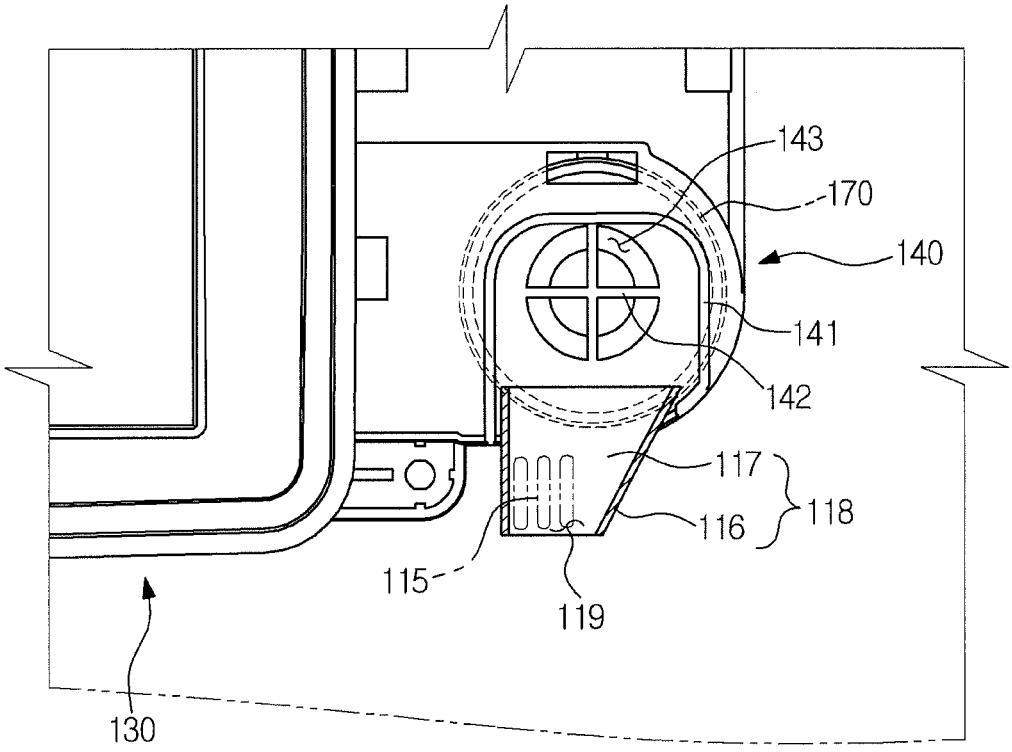
FIG. 4 is an enlarged view illustrating a speaker housing shown on FIG. 3.
Figure 5:
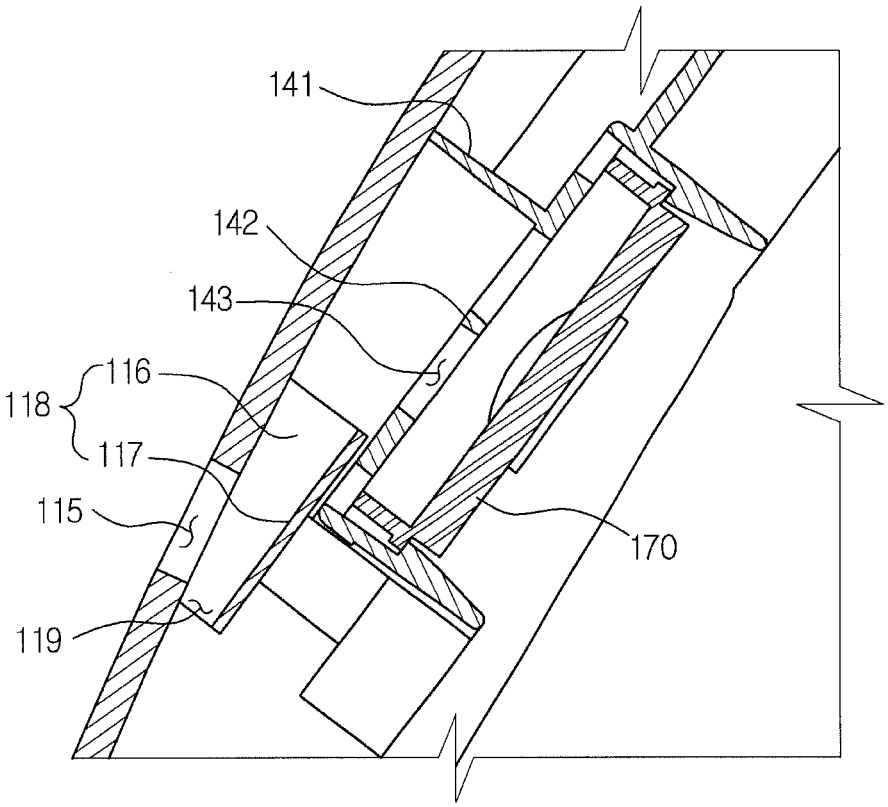
FIG. 5 is a cross sectional view illustrating the coupling relationship among a cover, a speaker housing and a speaker shown on FIG. 3.

FIG. 4 is an enlarged view illustrating a speaker housing shown on FIG. 3. FIG. 5 is a cross sectional view illustrating the coupling relationship among a cover, a speaker housing and a speaker shown on FIG. 3.

Referring to FIGS. 4 and 5, the speaker housing 140, on which the speaker 170 is mounted, is mounted at the rear of the control panel 110.

A speaker hole 115 is formed through a lower portion of a predetermined position of the control panel 110, the predetermined position corresponding to the speaker 170, so that the sound generated from the speaker 170 is transmitted to the front of the control panel 110.

A shielding unit 118 is formed at a rear of the speaker hole 115 to prevent moisture being introduced through the speaker hole 115 from being infiltrated to the speaker 170 or the main board 160. The shielding unit 118 includes a side shielding film 116 and a rear shielding film 117.

At the rear surface of the control panel 110, the side shielding film 116 is formed at both sides of the speaker hole 115 while protruding to the rear side. The side shielding film 116 may be provided in two units thereof, one for each side of the speaker hole 115.

The two side shielding films 116 may be inclined so as to be adjacent to each other while coming together from the upper side to the lower side. Although one of the two side shielding films is illustrated as being inclined, the present disclosure is not limited thereto. Having both of the side shielding films inclined may be included in the aspect of the present disclosure.

Due to the side shielding film 116 being inclined, the sound generated from the speaker 170 disposed at the upper side is guided toward the speaker hole 115. In addition, even if moisture is infiltrated to the rear side of the control panel 110 through the speaker hole 115, the moisture flows down along the side shielding film 116 that is inclined.

The rear shielding film 117 is formed in parallel to the control panel 110 while connecting the two side shielding films 116 to each other. The rear shielding film 117 is configured to block the rear side of the speaker hole 115 while being spaced apart from the speaker hole 115 such that the moisture is blocked from being infiltrated through the speaker hole 115.

The side shielding film 116 and the rear shielding film 117 cover the rear side and the lateral side of the speaker hole 115 while opening the lower side, thereby forming a drain hole 119.

The moisture being infiltrated into the speaker hole 115 is drained through the drain hole 119 after being blocked by the side shielding film 116 and the rear shielding film 117.

The side shielding film 116 and the rear shielding film 117 form the shielding unit 118 at the rear side of the speaker housing 140.

The speaker 170 may be mounted at the rear surface of the speaker housing 140. On a region of the speaker housing 140 at which the speaker 170 is mounted, a part of the region is open to form the opening 143 such that the sound generated from the speaker 160 passes through the opening 143.

A protecting rib 142 is formed at the center of the opening 143 to protect the speaker 170 after the speaker 170 is mounted. The protecting rib 142 covers a part of the opening 143 to protect the speaker 170 without covering the whole area of the opening 143, so that the sound generated from the speaker 170 passes through the opening 143.

The guide rib 141 is formed around the opening 143 such that the sound passing through the opening 143 after being generated from the speaker 170 is guided toward the speaker hole 115. That is, the guide rib 141 is formed such that the sound passing through the opening 143 is fully transmitted to the speaker hole 115 without being spread to other direction.

Since the speaker hole 115 is formed at a lower side of the opening 143, the guide rib 141 is provided in a form opening at a lower side of the opening 143 while covering an upper side, a left side and a right side of the opening 143.

The guide rib 141 is formed to connect to the side shielding film 116 such that the sound being generated from the speaker 170 is guided toward the speaker hole 115.

Figure 6:
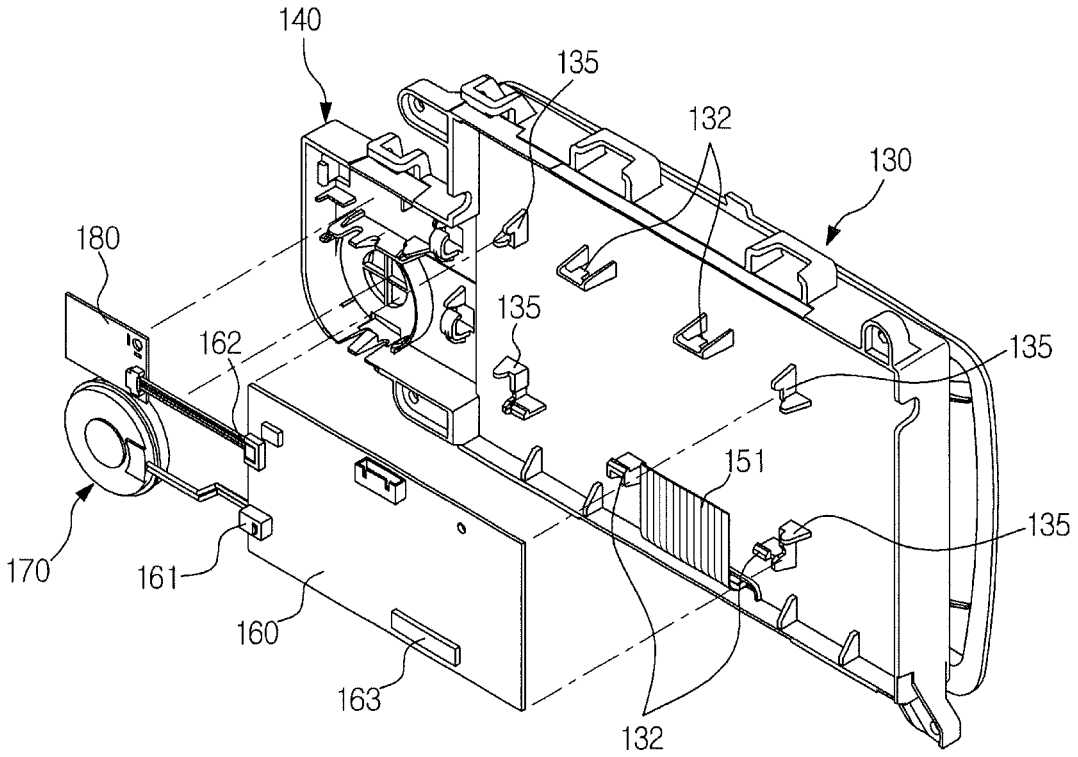
FIG. 6 is a perspective view illustrating a configuration coupled at a rear of a housing shown on FIG. 3.

FIG. 6 is a perspective view illustrating a configuration coupled at a rear of a housing shown on FIG. 3.

Referring to FIG. 6, the housing 120 includes the display housing 130 and the speaker housing 140.

The speaker 170 and the communication module 180 are disposed at the rear of the speaker housing 140. Meanwhile, the display unit 150 is disposed on the front surface of the display housing 140 and the main board 160 is disposed on the rear surface of the display housing 140.

A plurality of first fixing clips 132 is provided on the rear surface of the display housing 140 to fix the main board 160. The plurality of first fixing clips 132 supports the edge of the main board 160 such that the main board 160 is fixed to the rear surface of the display housing 140.

A position determining protrusion 135 is formed at a portion of the display housing 140 corresponding to each corner of the main board 160. The position determining protrusion 135 is configured to restrict each corner of the main board 160 such that the main board 160 is fixed to the rear side of the display housing 140 at a precise position.

Although the main board 160 in accordance with an embodiment of the present disclosure is illustrated as being mounted to the display housing 130 by only use of the first fixing clip 132, the present disclosure is not limited thereto. Having the main board 160 fixed to the display housing 130 by use of an additional fastening member may be included in the aspect of the present disclosure.

Since the communication module 180, the speaker 170, and the cable 151 of the display unit 150 need to be coupled to the main board 160, the main board 160 needs to be fixed at a precise position.

The cable 151 connected to the display unit 150 extends to the rear of the display housing 130 through the through-hole (137 in FIG. 3) and then is connected to a first connector 163 provided on the main board 160.

The main board 160 may be provided at one side thereof with a second connector 161 to which the speaker 170 is connected by cable 175, and a third connector 162 to which the communication module 180 is connected.

Figure 7:
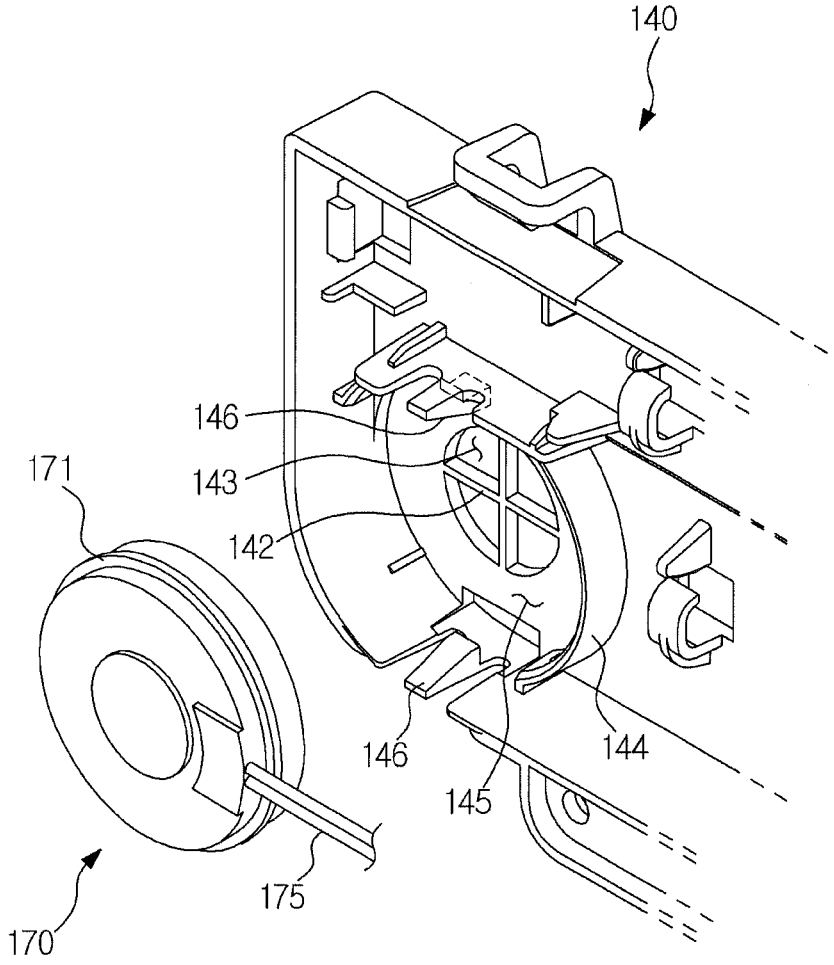
FIG. 7 is an enlarged view illustrating a speaker housing shown on FIG. 6.

FIG. 7 is an enlarged view illustrating a speaker housing shown on FIG. 6.

Referring to FIG. 7, the speaker 170 is disposed at the rear of the speaker housing 140.

A fixing rib 144 protrudes from the rear surface of the speaker housing 140 in a shape corresponding to the external appearance of the speaker 170. A speaker mounting part 145 is formed at an inner side of the fixing rib 144 such that the speaker 70 is mounted on the speaker mounting part 145. The fixing rib 144 is provided in a shape corresponding to the shape of the speaker 170, and the speaker mounting part 145 is provided in a size suitable for the speaker 170 to be mounted thereon.

A plurality of fixing clips 146 is formed adjacent to the speaker mounting part 145 of the speaker housing 140. A fixing protrusion 171 is formed from a lateral side of the speaker 170 in a radial direction from the speaker 170.

As the speaker 170 is mounted on the speaker mounting part 145, the plurality of second fixing clips 146 supports the fixing protrusion 171, so that the speaker 170 is fixed to the speaker housing 140.

The opening 143 is formed through the center portion of the speaker mounting part 145 such that the sound generated from the speaker 170 is transmitted through the opening 143. The protecting rib 142 is formed at the opening 143 to protect the speaker 170.

Figure 8:
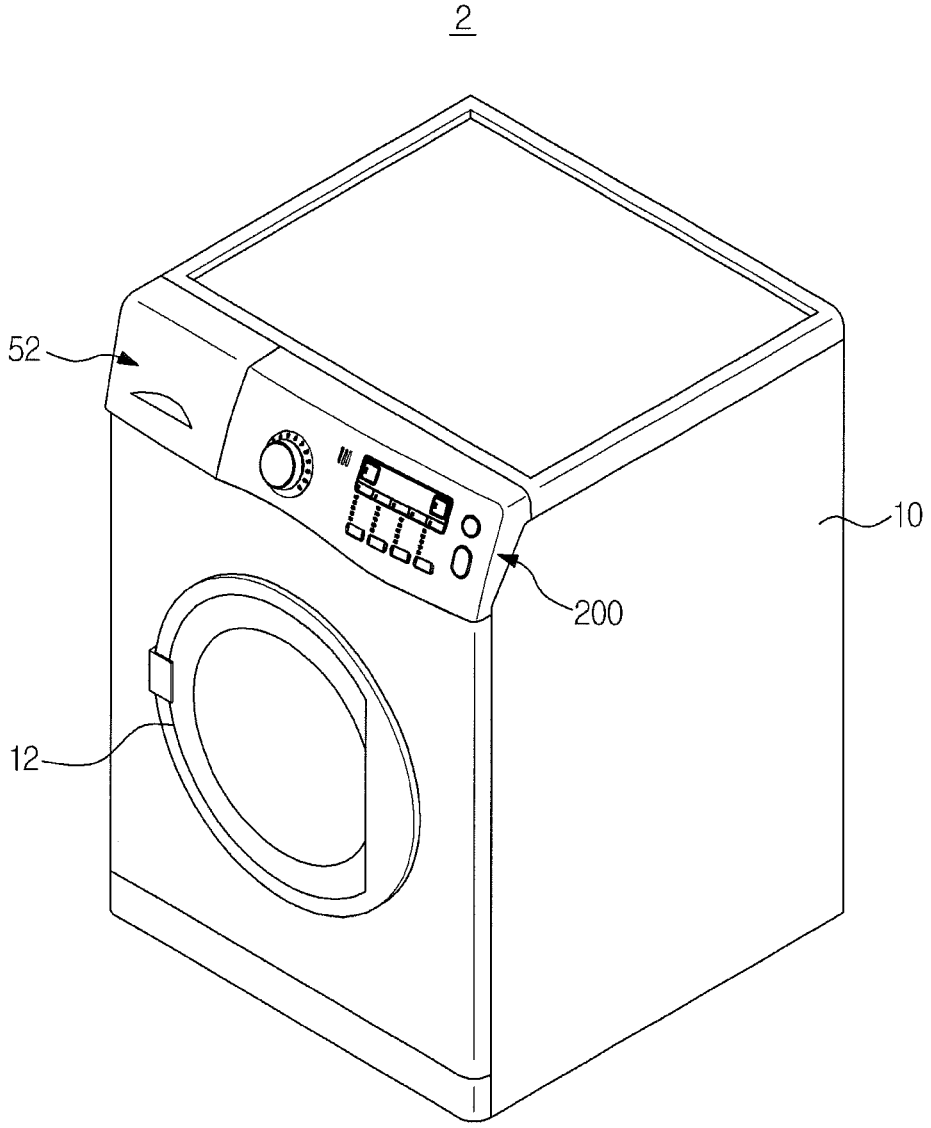
FIG. 8 is a perspective view illustrating a washing machine in accordance with another aspect of the present disclosure.
Figure 9:
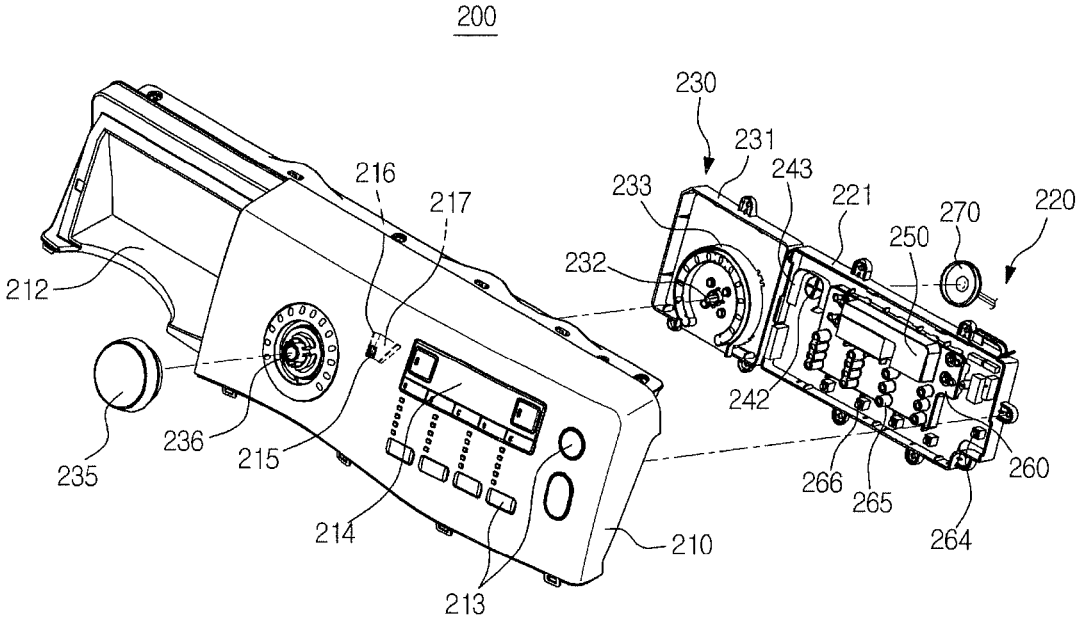
FIG. 9 is a perspective view illustrating the configuration of a control panel assembly of the washing machine shown on FIG. 8.

FIG. 8 is a perspective view illustrating a washing machine in accordance with another aspect of the present disclosure. FIG. 9 is a perspective view illustrating the configuration of a control panel assembly of the washing machine shown on FIG. 8.

Referring to FIGS. 8 and 9, a washing machine 2 includes a cabinet 10 forming the external appearance of the washing machine 2, and a control panel assembly 200.

The control panel assembly 200 includes a control panel 210 that forms the external appearance of the control panel assembly 200 while being slantingly mounted on an upper portion of a front surface of the cabinet (10 in FIG. 1), a circuit board assembly 220 disposed at a rear of the control panel 210, a rotary switch 230 disposed in parallel to the circuit board assembly 220 at the rear of the control panel 210, and a knob 235 connected to the rotary switch 230 while being mounted on a front surface of the control panel 210.

The circuit board assembly 220 includes a printed circuit board 260, and a circuit board housing 221 on which the printed circuit board 260 is mounted.

A plurality of first light emitting units 265 are mounted on the printed circuit board 260 to display a setting state set by a user, and a display device 250 to display the operating status of the washing machine 2.

At the circuit board housing 221, a plurality of setting switches 266 are disposed at a lower side of the printed circuit board 260 for a user to manipulate the washing machine 2.

At the circuit board housing 221, a power switch 264 is disposed at one side of the printed circuit board 260 to turn on/off the washing machine 2.

A switch housing 231 forms the external appearance of the rotary switch 230. A rotary rod 232 is provided at the center of the switch housing 231. The rotary rod 232 is coupled to the knob 235 so as to generate a plurality of signals in stages while rotating together with the knob 235.

A second light emitting unit 233 is provided around the rotary rod 232 so as to flicker such that the wash course corresponding to the degree of rotation of the knob 235 is indicated while indicating the degree of rotation of the knob 235.

A detergent container accommodating port 212 is provided at one side of the control panel 210 while being penetratively formed through the control panel 210 such that a detergent container 52 is detachable toward the inside the cabinet 10.

A knob mounting part 236 is formed at the center of the control panel 210 such that the knob 235 is mounted on the knob mounting part 236. The rotary switch 230 is installed at the rear of the knob mounting part 236.

A plurality of buttons 213 is disposed at one side of the control panel 210 to cover the setting switch 266 and the power switch 264 for a user to smoothly press the switches 266 and 264.

A display window 214 is provided at a position of the control panel 210 corresponding to the display device 250 such that an image formed from the display device 250 is displayed to the front of the control panel 210.

A speaker 270 is mounted at a rear of one side of the circuit board housing 221.

A speaker hole 215 is provided at a lower side of a region of the control panel 210, the region corresponding to the speaker 270, such that the sound generated from the speaker 270 is transmitted to the front of the control panel 210.

A side shielding film 216 is formed at the rear surface of the control panel 210 while protruding from the both sides of the speaker hole 215 to the rear side of the control panel 210. The side shielding films 216 is provided in two units thereof, one for each side of the speaker hole 215. The two side shielding films 216 are inclined to be adjacent to each other while nearing each other from the upper side to the lower side.

A rear shielding film 217 is formed to connect the two side shielding films 216 to each other while in parallel to the control panel 210.

At a region of the circuit board housing 221 on which the speaker 270 is mounted, an opening 243 is penetratively formed through a part of the region of the circuit board housing 221.

A protecting rib 242 is formed at the center of the opening 243.

A guide rib 241 is formed around the opening 243 such that the sound generated from the speaker 270 is guided toward the speaker hole 215 after passing through the opening 243.

Since the speaker hole 215 is formed at a lower side of the opening 243, the guide rib 241 is provided in a form opening at a lower side of the opening 243 while covering a left side and a right side of the opening 243.

The guide rib 241 is formed to be connected to the side shielding film 216 such that the sound generated from the speaker 270 is guided toward the speaker hole 215.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet;

a control panel disposed on a front surface of the cabinet;

a display unit installed on the control panel such that a front surface of the display unit is exposed through a front of the control panel;

a speaker housing installed behind the control panel;

a speaker mounted on the speaker housing; and a shielding unit formed at a rear surface of the control panel to cover a rear of the speaker hole;

wherein the control panel comprises a speaker hole formed so that sound generated from the speaker is transmitted to outside the control panel, the speaker hole being disposed to be spaced apart from the speaker, and wherein the speaker housing comprises a guide rib formed around an opening in the speaker housing while protruding between the speaker housing and the control panel the guide rib being configured so that sound from the speaker is transmitted toward the speaker hole formed through the control panel.

2. The washing machine of claim 1, wherein the shielding unit comprises at least one side shielding film protruding from the control panel to the rear of the control panel so as to block moisture from being introduced to the inside the control panel through the speaker hole.

3. The washing machine of claim 2, wherein the side shielding film comprises a first-side shielding film and a second-side shielding film that are formed at both sides of the speaker hole, respectively.

4. The washing machine of clam 3, wherein at least one of the first-side shielding film and the second-side shielding film is inclined such that the first-side shielding film and the second-side shielding film are adjacent to each other while coming together from the speaker to the speaker hole.

5. The washing machine of claim 2, wherein the side shielding film is configured to guide the sound, which is generated from the speaker, to the speaker hole.

6. The washing machine of claim 2, wherein the shielding unit further comprises a rear shielding film provided in parallel to the control panel so as to block the moisture from being introduced to the inside the control panel.

7. The washing machine of claim 6, wherein the rear shielding film is supported by the at least one side shielding film.

8. The washing machine of claim 1, wherein the shielding unit comprises a drain hole that is formed while being open through a lower end of the shielding unit to discharge moisture that is input through the speaker hole.

9. The washing machine of claim 1, wherein the speaker is mounted at a rear side of the speaker housing, and the speaker housing comprises the opening that is open through a part of the speaker housing.

10. The washing machine of claim 9, wherein the guide rib is provided adjacent to the opening.

11. The washing machine of claim 1, wherein the display unit comprises a display unit in a touch screen scheme.

12. The washing machine of claim 1, wherein the display unit comprises a touch sensor.

13. A washing machine comprising:

a cabinet; and a control panel assembly disposed on a front surface of the cabinet, wherein the control panel assembly comprises a control panel forming an external appearance of the control panel assembly, control panel comprising a speaker hole formed while being open through a part of the control panel;

a speaker housing disposed at a rear of the control panel;

a speaker mounted on the speaker housing;

a guide rib formed around an opening in the speaker housing while protruding between the speaker housing and the control panel; and a shielding film formed between the speaker housing and the control panel, the shielding film being connected to the guide rib, wherein the guide rib and the shielding film are configured to guide sound generated from the speaker toward the speaker hole formed through the control panel.

14. The washing machine of claim 13, wherein the speaker hole is located at a position lower than a position of the speaker.

15. The washing machine of claim 13, wherein the guide rib protrudes from a rear surface of the control panel.

16. The washing machine of claim 13, wherein the guide rib protrudes from a front surface of the speaker housing.

17. The washing machine of claim 13, wherein the speaker housing comprises at least one fixing clip configured to fix the speaker to a rear surface of the speaker housing.

18. The washing machine of claim 17, wherein the speaker comprises a fixing protrusion that is configured to be fixed to the fixing clip.

* * * * *